US009578702B2

(12) United States Patent
Siessegger et al.

(10) Patent No.: US 9,578,702 B2
(45) Date of Patent: Feb. 21, 2017

(54) SYNCHRONIZED PWM-DIMMING WITH RANDOM PHASE

(71) Applicants: Bernhard Siessegger, Danvers, MA (US); Reinhard Lecheler, Neuburg/Donau (DE)

(72) Inventors: Bernhard Siessegger, Danvers, MA (US); Reinhard Lecheler, Neuburg/Donau (DE)

(73) Assignee: OSRAM SYLVANIA Inc., Wilmington, MA (US)

( * ) Notice: Subject to any disclaimer, the term of this patent is extended or adjusted under 35 U.S.C. 154(b) by 93 days.

(21) Appl. No.: 14/273,732

(22) Filed: May 9, 2014

(65) Prior Publication Data

US 2015/0327340 A1 Nov. 12, 2015

(51) Int. Cl.
*H05B 33/08* (2006.01)

(52) U.S. Cl.
CPC ..... *H05B 33/0818* (2013.01)

(58) Field of Classification Search
None
See application file for complete search history.

(56) References Cited

U.S. PATENT DOCUMENTS 3,749,884 A * 7/1973 Detmann ..... G05F 1/452 219/494
6,489,742 B2 * 12/2002 Lumsden ..... H02P 27/02 318/727
7,106,564 B2 * 9/2006 Deng ..... H02J 3/38 361/187
2008/0042596 A1 * 2/2008 Kanechika ..... G09G 3/3406 315/291
2009/0303161 A1 * 12/2009 Messmer ..... G09G 3/14 345/55
2010/0020108 A1 * 1/2010 Cho ..... G09G 3/3406 345/690
2010/0148676 A1 * 6/2010 Simmers ..... H05B 33/086 315/152

(Continued)

OTHER PUBLICATIONS

Duncan Waters, International Search Report and Written Opinion of the International Searching Authority for PCT/US2015/029851, Jul. 6, 2015, pp. 1-8, European Patent Office, Rijswijk, The Netherlands.

*Primary Examiner* — Crystal L Hammond
(74) *Attorney, Agent, or Firm* — Yutian Ling

(57) ABSTRACT

PWM-based dimming techniques are provided for lighting systems. The techniques can be used to eliminate or otherwise reduce the potential for strobing and flickering, and may be implemented, for example, in a driver suitable for powering LED lighting systems, but can be used with other suitable light sources as well. In an example embodiment, the potential for line frequency induced flicker, or even line disturbances that are periodic with the line frequency, can be eliminated or reduced by synchronizing the PWM frequency to the line frequency or so-called mains frequency, and the potential for strobing can be eliminated or reduced by either using a randomized phase angle on a cycle-to-cycle basis or by using multiple PWM LED drive circuits all having constant cycle-to-cycle phase angle but a different phase angle from drive circuit to drive circuit (or different from LED string to LED string, as the case may be).

25 Claims, 12 Drawing Sheets

(56) References Cited

U.S. PATENT DOCUMENTS

| | | | | |
|---|---|---|---|---|
| 2010/0188012 | A1* | 7/2010 | Xu | H05B 33/0818 315/287 |
| 2010/0194293 | A1* | 8/2010 | Deurenberg | H05B 33/0818 315/159 |
| 2012/0147066 | A1* | 6/2012 | Fujiwara | G09G 3/3413 345/690 |
| 2012/0306401 | A1* | 12/2012 | Wei | H05B 33/0845 315/224 |
| 2014/0111110 | A1* | 4/2014 | Qi | H05B 33/0818 315/210 |
| 2015/0264769 | A1* | 9/2015 | Jelaca | H05B 33/0845 315/206 |

* cited by examiner

SYNCHRONIZED PWM-DIMMING WITH RANDOM PHASE

FIELD OF THE DISCLOSURE

The present application relates to lighting systems, and more specifically to modulated dimming techniques that eliminate or otherwise reduce flicker and strobing.

BACKGROUND

Light emitting diodes (LEDs) are often used in lighting systems and can be configured into an array of LED strings, wherein the LED array is powered by a so-called driver or power supply. Like other light sources, the brightness of the LEDs can be controlled or dimmed as desired for a given lighting application. Pulse width modulated (PWM) dimming is widely used for LED brightness control. There are a number of issues with flicker and strobing associated with PWM dimming. Strobing can be generally defined as the translation of temporal light modulation into spatial modulation through motion of the source, objects or viewer. In contrast, flicker can be generally defined as the perception of light modulation without motion of the source, objects or viewer, which generally happens with modulation frequencies between 0 Hz and 100 Hz (no flicker at a modulation frequency of 0 Hz, worst case flicker sensitivity at a modulation frequency of about 10 Hz, and no perceptible flicker at modulation frequencies greater than 100 Hz).

DETAILED DESCRIPTION

Figure 1A:
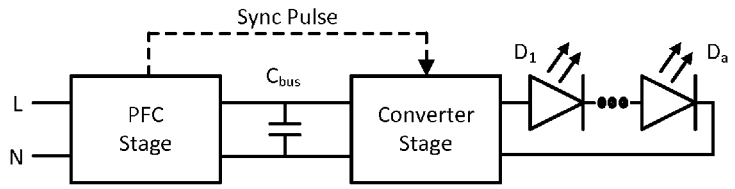
FIG. 1*a* illustrates a block diagram of single-channel LED driver configured for synchronized PWM dimming with random phase, in accordance with an embodiment of the present invention.

PWM-based dimming techniques are provided for lighting systems. The techniques can be used to eliminate or otherwise reduce the potential for strobing and flickering, and may be implemented, for example, in a driver suitable for powering LED lighting systems, but can be used with other suitable light sources as well. In an example embodiment, the potential for line frequency induced flicker can be eliminated or reduced by synchronizing the PWM frequency to the line frequency or so-called mains frequency, and the potential for strobing can be eliminated or reduced by either using a randomized phase angle on a cycle-to-cycle basis or by using multiple PWM LED drive circuits all having constant cycle-to-cycle phase angle but a different phase angle from drive circuit to drive circuit (or different from LED string to LED string, as the case may be). Using randomized phase angle on a cycle-to-cycle basis can be used to prevent strobing by eliminating the repetitiveness of the light modulation (brightness vs. time) produced by LEDs powered from one or more LED drive circuits. Alternatively, using multiple PWM LED drive circuits all having constant cycle-to-cycle phase angle but different phase angle from drive circuit to drive circuit can be used to prevent strobing by reducing the modulation depth and/or increasing the frequency components of the light produced by more than one LED drive circuit. Thus, identical PWM-frequencies can be used (mains synchronized, in some embodiments), but the phase angles from cycle-to-cycle or between individual drivers/LED strings are purposely chosen to be different from each another. As will be appreciated in light of this disclosure, the techniques can be implemented to reduce strobing and flickering issues with little or no additional hardware.

General Overview

The brightness of an LED-based light source can be varied using either analog dimming or PWM dimming. With analog dimming, the amplitude of the current through the LEDs is varied, and with PWM dimming, the on-time during a given period with constant frequency is varied. In the latter case, the LED current is either 0 or a constant value. Typical PWM frequencies are in the range of 150 to 500 Hz. As previously explained, there are a number of issues with flicker and strobing associated with PWM dimming, particularly with PWM frequencies below 100 Hz. However, even though a PWM frequency above 100 Hz may be used, the interaction of the PWM modulation with the mains frequency may still lead to flicker. For instance, assume a two stage LED driver with a power factor correction (PFC) stage and a buck output stage. The PFC stage provides energy to the intermediate bus capacitor (e.g., $C_{bus}$ in FIG. 1*a*) which feeds the buck stage. The term PFC stage in this document generally refers to a passive or active power factor correction stage or any input stage having a rectifier. Due to non-idealities in the buck converter, the voltage ripple (with twice the line frequency) on the bus capacitor may lead to an LED current also having a ripple with twice the line frequency. The PWM modulation of such an LED current leads to sub-harmonic modulation which manifests as a flicker (e.g., a 100 Hz ripple frequency of the bus capacitor in case of a 50 Hz line frequency is beating with a 120 Hz PWM frequency and flicker of 20 Hz is present). Of course, one way to avoid such drawbacks associated with a PWM dimming scheme is to use analog current dimming. However, if PWM dimmed light sources are preferred, there are techniques that can be used to reduce the effects of flicker and strobing originating. One such technique includes high PWM frequencies (400 Hz and higher). Unfortunately, this approach comes with various potential drawbacks, like reduced dimming range (e.g., at 1 kHz PWM frequency, a 0.1% dim level would mean a pulse width of 1 microsecond) and/or increased cost and/or reduced efficiency. Another technique that can be used to eliminate flicker and strobing effects involves the use of spread-spectrum modulation or so-called spread-spectrum PWM, wherein the frequency of the PWM is changed rapidly within a given frequency range around an average PWM frequency. However, this technique tends to be costly particularly with respect to processing power and memory, and may further be prone to undesired low frequency manifestations.

Thus, and in accordance with an embodiment of the present invention, PWM dimming techniques are provided to eliminate or otherwise reduce issues associated with flicker and/or strobing. In general, the PWM frequency is synchronized to the line frequency to prevent or reduce flicker, and a randomized phase angle can be used either on a PWM cycle-to-cycle basis for one or more PWM drivers (Method A) or a driver-to-driver basis for multiple PWM drivers (Method B) to prevent or reduce strobing. The driver can be implemented with any number of topologies, as will be appreciated in light of this disclosure. One specific example configuration is an LED driver including a PFC stage operatively coupled with a converter stage. The PFC stage may include rectification and filtering, and the converter stage can be implemented with a buck converter (although other topologies such as boost or buck-boost can be used as well, depending on the given application and mains). In any such cases, a powerline-derived DC communication can be used for providing sync pulses to the converters (no dedicated sync wire needed).

PWM Frequency Synchronized to Line Frequency. In one specific example embodiment, a PWM frequency $f_{PWM}$ is used that is k times twice the line frequency $f_L$ ($f_{PWM}=k*2*f_L$), where k can be chosen to be any positive integer number larger than 0. By using a driver that obeys $f_{PWM}=k*2*f_L$, the potential for flicker induced by influences with line frequency is eliminated or otherwise reduced. The synchronization of the PWM frequency $f_{PWM}$ to the line frequency $f_L$ can be achieved in a number of ways, as will be appreciated in light of this disclosure. For instance, in one example case a sync pulse is generated by a PFC stage of an LED driver which is in turn fed to a phase-lock-loop circuit of that driver. The phase-lock-loop circuit in turns controls the PWM frequency with which a buck converter of the LED driver is turned on and off to create the PWM modulated LED current. Assume k equals 2, such that the PWM frequency $f_{PWM}=k*2*f_L$ is four times the line frequency $f_L$, in accordance with an embodiment. Other suitable sync schemes can be used as will be appreciated in light of this disclosure, including those where the PWM frequency $f_{PWM}$ is X times the line frequency where X equals any integer greater than 1 and any undesired sub-harmonic modulation is avoided.

Randomized Phase Angle on a PWM Cycle-to-Cycle Basis (Method A). With respect to strobing, using a randomized phase angle on a PWM cycle-to-cycle basis effectively eliminates the repetitiveness of the light modulation (brightness vs. time) produced by LEDs powered from one or more LED drive circuits. In one embodiment, at the beginning of each PWM cycle a (quasi-)random delay time T is generated. After the delay time T has lapsed, the output of the driver delivers current to the LEDs for a time period of $D*T_{LED}$, where D is the duty cycle and $T_{LED}$ is the PWM period. The delay time T is a random time which is equally/uniformly distributed between 0 and $T_{LED}-D_1*T_{LED}$. The delay time T may be generated, for example, by using quasi-random numbers from a microcontroller or other digital control circuitry. As a result, the generated delay times may show significant quantization effects (similar to quantization effects seen in conjunction with $T_{LED}$ or $D_1*T_{LED}$). In one specific such embodiment, the delay time generated at the beginning of each PWM cycle is derived from a sequence of quasi-random numbers that are generated by a random number generator inside digital control circuitry of the LED driver. Any suitable random number generation techniques can be used. In addition, using multiple LED drive circuits (in a given illuminated space, and hence multiple LED strings in that space) allows for the modulation depth of the generated light to be reduced. In this context, note that it is irrelevant whether those drive circuits reside in single channel output LED drivers or multiple channel output LED drivers or any combination of such drivers. Rather, each output of a multiple channel LED driver may be considered a drive circuit. In a typical scenario involving PWM modulated light, the light at any point in a given space is composed of modulated light coming from different PWM modulated sources. This means that as long as the modulation of the respective drivers is not identical or otherwise inadequately spaced the average modulation depth of the composed light can be reduced compared with the light coming from any one individual source in that space. As will be appreciated in light of this disclosure, the better the mixing of the various given light sources the lower the average modulation depth will be. Thus, some consideration to optical and spatial arrangements of the lighting scheme can further be used to optimize or otherwise increase the effectiveness. As will be further appreciated in light of this disclosure, note that having LED drive circuits using different sequences of quasi-random numbers will generally work well. However, for sake of simplicity, further note that the sequence of quasi-random numbers used may be the same for all drive circuits. Even in such arrangements having a common sequence of quasi-random numbers a reduction of modulation depth can be achieved. In more detail, at a given point in time, the different LED drive circuits should be at different positions within the sequence of quasi-random numbers. In accordance with one embodiment, a sequential start-up of the different LED drive circuits can be used to provide such a constellation, although this may not be practical in some applications. Thus, in accordance with another embodiment, in order to provide a desired level of "quasi-randomness" at start-up (even when all LED drive circuits are powered up at the same time), the starting point within the common sequence of quasi-random numbers is calculated at start-up of the drive circuit based on the series number of the driver (which is typically a unique number written to non-volatile memory during the production process of the driver). Other suitable data specific to individual LED drivers may be used (e.g., unit ID, logical address, etc) in other embodiments (as will be described in turn).

Multiple Drive Circuits with Constant Cycle-to-Cycle Phase Angle but Different Phase Angles from Drive Circuit to Drive Circuit (Method B). This approach aims towards eliminating or otherwise reducing strobing by reducing the modulation depth and/or increasing the frequency components of the light produced by more than one LED drive circuit. In an example embodiment, all multiple LED drive circuits of a given lighting system have identical PWM-frequencies, and phase angles of individual LED drive circuits are constant from cycle-to-cycle. In addition, the phase angles of individual LED drive circuits are purposely chosen in such a way that drive circuits driving LED strings contributing significantly to the illumination at any given point in the illuminated space are different from drive circuit to drive circuit, such that times when all LED strings are off are eliminated or otherwise reduced. To this end, the potential for strobing is effectively reduced in a similar fashion as previously described in the case of randomized phase angle on a PWM cycle-to-cycle basis for multiple LED drive circuits, such that the light at any point in a given lit space is composed of light coming from different PWM modulated sources. The average modulation depth of the composed light is reduced and/or the frequency components of the produced light are increased compared with the light coming from any one of the individual sources in that space. Both effects reduce the potential for strobing in that space.

As will be appreciated in light of this disclosure, note that Method A reduces the potential for strobing even if there is only a single LED drive circuit present, whereas Method B uses multiple drive circuits and relies on the assumption the light generated by the LEDs powered from those drive circuits will (at least partially) be superimposed at a given point in the lit space. In this sense, Method B may be considered not as powerful as method A. However, further note that Method B doesn't require any computation on a cycle-by-cycle basis (e.g., for generating a random phase-shift, hence there is no additional computational loading of the microcontroller or processor).

Phase Angle Selection for Method B. For each point in space of an illuminated space, dominant light sources can be defined as light sources that contribute significantly to the illumination of that point. To make Method B most effective, the phase difference between the distinct PWM modulated dominant light sources (drivers) can be maximized, in accordance with an embodiment. The (average) number of dominant light sources (f) for an illuminated space is defined as the number of light sources averaged over all relevant points in that illuminated space. As will be appreciated, whether a given point in the space is "relevant" or not will depend on the use of the space (e.g., points more than 2 meters above the floor may be considered irrelevant in an office environment).

For purposes of discussion, assume that there is a number f of dominant light sources. In one example embodiment, the phase angle $\phi_i$ of $i^{th}$ light source is chosen to be: $\phi_i=(i-1)*\Delta\phi+\phi_0$, where $i=1, \ldots, f$, $\Delta\phi=360°/f$, and $\phi_0$ is an arbitrary and constant phase offset. The phase angles so calculated are quantized and equidistant, and thus can be computed easily with digital control. In a given installation, a number f of dominant light sources can be selected that will best fit the setup. Oftentimes, it may be desirable to choose a number f in advance of knowing what the setup area to be lit will look like (such choice may be made, for example, at the time of driver manufacturing). In such cases, note that f may be chosen in advance based on a specific product and hence a specific application. For instance, for standard office lighting an appropriate value of f may be in the range of 4 to 32. In one example scenario, in an office space with 400 LED drive circuits and f chosen to be 8, there will be about 50 LED drive circuits with identical phase angles.

As previously indicated, the phase angle of a drive circuit is different from surrounding drive circuits that are lighting a common point or area, in accordance with an embodiment. In case of LED drivers with multiple outputs, assume that these outputs will power LED strings (light sources) that are in close proximity to each other. Further assume that the number f of dominant light sources in the application is not known, but that the assumption that f is at least as large as the number of driver outputs i is acceptable in most applications, in accordance with an embodiment. Further assume that the light from the multi-channel driver will be most dominant in its close proximity and therefore setting f to n is also an acceptable approximation, in accordance with an embodiment. Hence, the phase angle of the $i^{th}$ channel of the n-channel driver can be: $\phi_i=(i-1)*\Delta\phi+\phi_0$, where $i=1, \ldots, n$, $\Delta\phi=360°/n$, and $\phi_0$ is an arbitrary and constant phase offset (identical for all n channels). Note that this selection of $\phi_i$ is also favorable with regards to minimizing current ripple through the bus capacitor fed by the PFC circuit in the case of a two or more stage LED driver design. A phase shift between multiple-channel LED drivers (and hence their channels) is recommended and can be achieved by selecting random/different phase offsets accordingly. In accordance with one embodiment, the phase offset $\phi_{0j}$ of the $j^{th}$ n-channel driver is preferably set to be $\phi_{0j}=(j-1)*(n/f)*360°$ with $j=1, \ldots, f/n$ (assume that f was chosen to be divisible by n without remainder). The phase angle of the $i^{th}$ channel of the $j^{th}$ n-channel driver therefore is: $\phi_{0j}=(i-1)*\Delta\phi+\phi_{0j}$, where $i=1, \ldots, n$, $\Delta\phi=360°/n$. The implementation of a uniform distribution of the random/different (e.g., by using methods $B_1$ through $B_3$ described herein) phase offsets $\phi_0$ of the different n-channel drivers deployed will provide best results with respect to flicker and strobing.

Note that Method B may also be used to select the phase angle of an individual drive circuit. In general, selecting the phase angle of an individual drive circuit should ensure that the phase angles of all other drive circuits illuminating the same area as the drive circuit under consideration are different. There are a number of ways to achieve this general goal, including the following methodologies (Methods $B_1$ through $B_3$).

Method $B_1$. One method involves individual programming of LED drivers in the field based on their location in the space. Even though this approach may give very good results it can be quite cumbersome. To this end, other methods provided herein do not require individual programming in the field or individual/manual programming based on spatial information of the actual space the LED drivers will be used in.

Method $B_2$. With this methodology, at every power-up of the LED drive circuit (after applying power, or waking up from sleep mode, etc.), a random phase angle is generated that can be used as long as the drive circuit is operating. This random phase shift may be generated from a pseudo-random number which may (on purpose) have significant quantization as previously explained.

Method $B_3$. With this methodology, the LED drive circuit uses the same phase angle at every start-up. Compared with Method $B_2$ (which generates a phase angle at every power-up) Method $B_3$ has the advantage of excellent reproducibility in the field, as phase angles do not change over time. One of the following actions (Action $B_1$ through $B_3$) can be used to ensure that the phase angle is different from the phase angle of surrounding drive circuits, in accordance with an embodiment.

Action $B_1$: Phase angle is programmed into the LED drive circuit during production. The phase angle may be directly programmed into the LED driver but it may also be indirectly determined based on other data (such as data that was programmed into the driver during production). At start-up that data is used to determine the phase angle. Numerous techniques can be used for indirectly setting the phase angle. One example includes the case where the microcontroller or other processor inside the LED driver computes the phase angle at every start-up, based on calibration data (e.g., data to trim the output of the driver to deliver exactly 350 mA or some other suitable drive current). In another example case, at every power-up the last 4 bits of the serial number of the LED driver (e.g., set during initial configuration at deployment time) are used to determine the phase angle. Numerous other sources of sufficiently random data associated with a given LED driver circuit can be similarly used to compute or determine the phase angle.

Action $B_2$: Phase angle is programmed into the LED drive circuit during commissioning (e.g., during deployment with a DALI-Tool phase angles are programmed into the drive circuits). Note that this may happen automatically in the background and invisibly to the user of the DALI-Tool. The spatial arrangement of the light sources within the commissioned space can be utilized to generate a highly effective assignment of phase angles, assuming that this information is available in the commissioning tool. Similar to Action $B_1$, there is also an indirect way of setting the phase angle based on other data programmed during the commissioning process (e.g., at every power-up the last 4 bits of the DALI-address set during commissioning can be used to determine the phase angle, wherein 4 bits correspond to f=16 different phase angles).

Action $B_3$: Phase angle is generated by the drive circuit itself at the very first power-up (e.g., through random generator). In this example case, the generated phase angle can be stored in non-volatile memory (e.g., EEPROM or FLASH) and gets read from this non-volatile memory at any power-up after the first power-up. In one such embodiment, at the time when the phase angle is stored in memory a status bit in that same memory is toggled, indicating that the first power-up has happened.

Thus, PWM dimming techniques are provided for LED brightness control, wherein issues with flicker and strobing are mitigated. The techniques can be applied to most LED driver setups without (or only very) little additional hardware and hence without (or very little) increase in BoM cost. Typically a microcontroller is provided for controlling the different stages of an LED power supply and hence specific timing with respect to synchronization and phase angle as provided herein can be implemented via software and/or firmware modifications that come without increase in BoM cost.

System Architecture

Figure 1B:
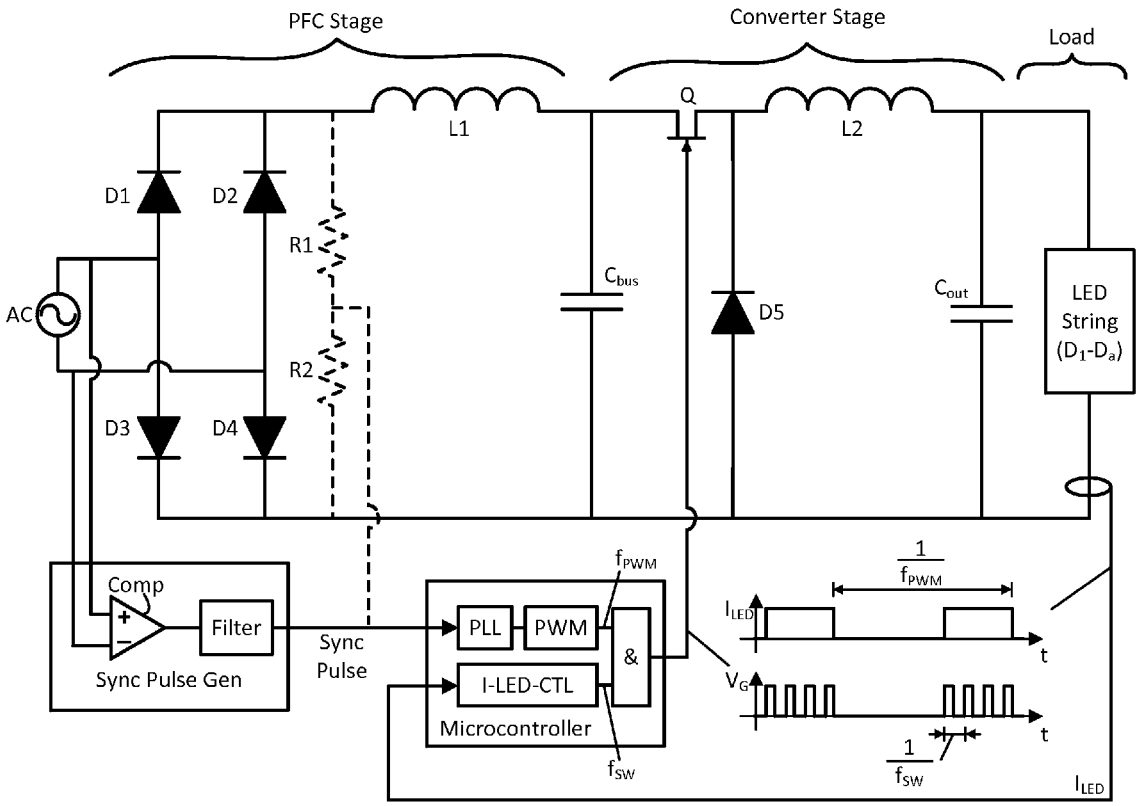
FIG. 1*b* illustrates a schematic diagram of the single-channel LED driver shown in FIG. 1*a*, in accordance with an embodiment of the present invention.

FIG. 1*a* illustrates a single-channel LED driver configured in accordance with an embodiment of the present invention. As can be seen, this example configuration is based on a PFC stage and a converter stage driving a string of LEDs $D_1$ through $D_a$. Although any of numerous switch-mode power conversion topologies such as buck, boost, buck-boost, and flyback can be used, assume this example embodiment includes a passive PFC stage and a buck output stage, such as schematically shown in FIG. 1*b*. As will be further appreciated in light of this disclosure, this example architecture generally allows for the creation of a randomized phase angle on a cycle-to-cycle basis.

In operation, the PFC stage receives power from an external AC source (line and neutral connections, or L and N as shown in FIG. 1*a*) and provides rectification with diodes D1-D4 and smoothing inductor L1. In some cases, such as where high peak inrush-currents can be tolerated, the inductor L1 may be omitted. The PFC stage provides energy to the intermediate bus capacitor $C_{bus}$ which feeds the buck converter stage and may also feed other lighting or non-lighting related circuitry. The buck converter stage generally operates to provide power to the load (LEDs $D_1$ through $D_a$) and includes switching element Q (e.g., FET or other suitable switch), diode D5, inductor L2 and output capacitor $C_{out}$. As previously explained, due to non-idealities in the buck converter, the voltage ripple (with twice the line frequency) on the bus capacitor $C_{bus}$ may lead to an LED current also having a ripple with twice the line frequency. The PWM modulation of such an LED current leads to sub-harmonic modulation which tends to manifest as a human-perceptible flicker. For instance, consider a 100 Hz ripple frequency of the bus capacitor in case of a 50 Hz line frequency is beating with a 120 Hz PWM frequency, such that a flicker of about 20 Hz is present.

So, to eliminate this potential for flicker in accordance with an embodiment of the present invention, a sync pulse is generated by the PFC stage and is fed to a phase lock loop (PLL) module controlling the PWM frequency output by the pulse width modulation (PWM) module with which the buck converter stage is turned on and off in order to create the PWM modulated LED current. A control loop including the LED current measurement stage and the controller I-LED-CTL is used to control the LED current, so that the LED current is constant while the PWM module has turned the buck converter stage on. As can be seen in the example embodiment of FIG. 1*b*, a sync pulse generator can be included in or otherwise operatively coupled to the line input of the PFC stage, and the PLL and PWM modules can be implemented in a microcontroller in or accessible to the converter stage.

The sync pulse generator in the example embodiment shown includes a comparator operatively connected to the line and depending on whether the polarity of the line is positive or negative the comparator provides a logic level output. This output signal can then be filtered as desired to remove noise or other undesired manifestations and would generally present as a square-wave having the AC line frequency. This output signal can be used as the sync pulse, as shown in FIG. 1*b*. The filter can be implemented with any suitable analog filter configuration (e.g., $2^{nd}$ order or higher low pass or band-pass filter), depending on the frequency band of interest and noise environment. In another embodiment, the PLL circuit can receive the sync pulse directly from the rectified output of the PFC stage as also shown in FIG. 1*b*, via the optional resistive divider of R1 and R2 (shown with dashed lines). In still other embodiments, the sync pulse generator can be implemented with a digital signal processor configured to sample the line voltage at the input of the PFC stage (or rectified voltage at the output of the PFC stage) and generate a corresponding sync pulse. In any such cases, the PLL module uses the sync pulse to determine the line voltage phase information, which is then conveyed to the PWM module, thereby allowing the output signal of the PWM module to be synchronized with the line frequency. Note that the PLL and PWM modules may be partially or entirely digital, such as software-based modules non-transiently encoded on processor readable medium(s). Alternatively, the PLL and PWM modules can be implemented in analog components, as is sometimes done.

Although the switching frequency $f_{SW}$ of the converter stage may vary from one embodiment to the next, assume it is about 500 kHz in this example case. Further assume a line frequency $f_L$ of about 60 Hz and that the LED driver complies with $f_{PWM}=k*2*f_L$, and that k was chosen to be 2, so that $f_{PWM}$ is four times the line frequency $f_L$. In such a case, the PWM frequency $f_{PWM}$ would be about 240 Hz. Note that the so-called switching frequency is different from the PWM frequency $f_{PWM}$.

In more detail, the switching frequency is the frequency of the power switches (transistors) in a power converter. Typically, an LED driver includes one, two or three (depending on the product) three sequentially connected power converters. The input to the first power converter is coupled to the line, and the output of the last power converter is coupled to the LEDs. Each power converter may have a different switching frequency. In general, the PWM frequency $f_{PWM}$ (typically in the range of 100 Hz to 1500 Hz) is much lower than the switching frequency (typically in the range 40 kHz up to 3 MHz). The PWM frequency $f_{PWM}$ is the frequency with which the LED current is pulsating (approximately a square-wave). The pulsating LED current creates a pulsating luminous flux. The human eye integrates over the light and it sees different brightness depending of the duty cycle of this PWM modulated square-wave pulsating light. This is the mode of operation is generally referred to herein as PWM dimming. The amplitude of the LED current is constant and can be set so that 100% duty cycle provides the desired luminous flux. In some cases, note that the last power converter as a whole can be turned on and off to create the PWM modulated current. In other cases, the last power converter is primarily just a controlled additional transistor in series to the output of the prior to last power converter and in series to the LEDs. This last converter can be used to create the PWM modulated current. Numerous such configurations will be apparent in light of this disclosure.

Figure 2:
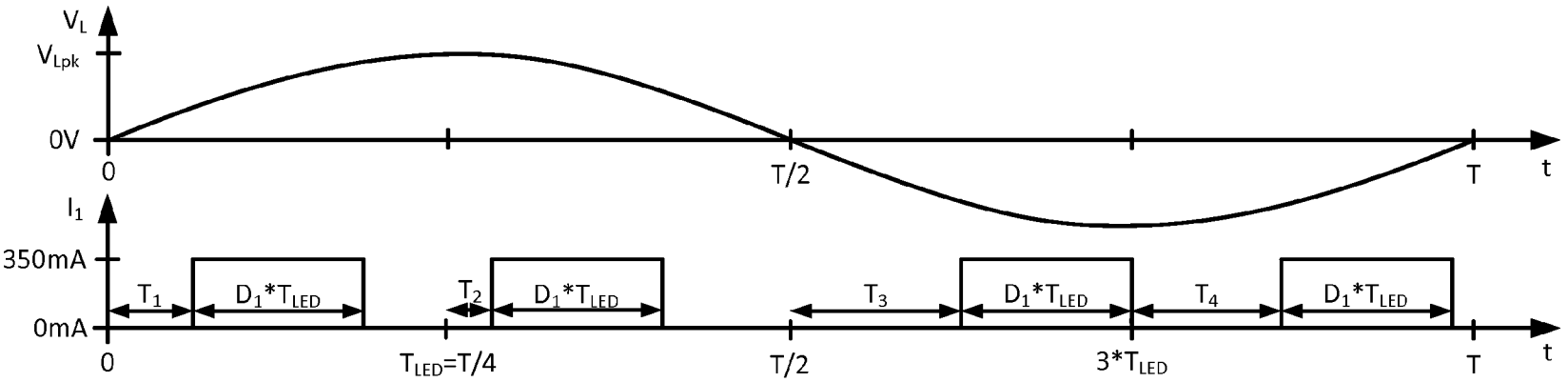
FIG. 2 graphically illustrates the line voltage fed to the driver shown in FIG. 1*a* and the output current of the driver, in accordance with an embodiment of the present invention.

FIG. 2 shows the line voltage $V_L$ fed to the driver shown in FIG. 1 and its output current $I_1$. The line period T shown in the upper part of the graph corresponds to a line frequency of $f_L$=60 Hz=1/T. The PWM frequency is $f_{PWM}=4*f_L$=240 Hz. For illustration purposes a constant duty cycle $D_1$=50% is shown. The varying delay times $T_1$ through $T_4$ are clearly visible. As can be seen, at the beginning of each PWM cycle a (quasi-)random delay time ($T_1$, $T_2$, $T_3$, and $T_4$, generally referred to as delay time $T_N$) is generated. After the delay time $T_N$ has lapsed, the output of the driver delivers current to the LEDs for a time period of $D_1*T_{LED}$, where $D_1$ is the duty cycle and $T_{LED}$ is the PWM period. The delay time $T_N$ is a random time which is equally distributed between 0 and $T_{LED}-D_1*T_{LED}$. The delay time $T_N$ may be generated, for example, by using quasi-random numbers from a microcontroller or other digital control circuitry. As a result, the generated delay times may show significant quantization effects (similar to quantization effects seen in conjunction with $T_{LED}$ or $D_1*T_{LED}$).

Figure 3:
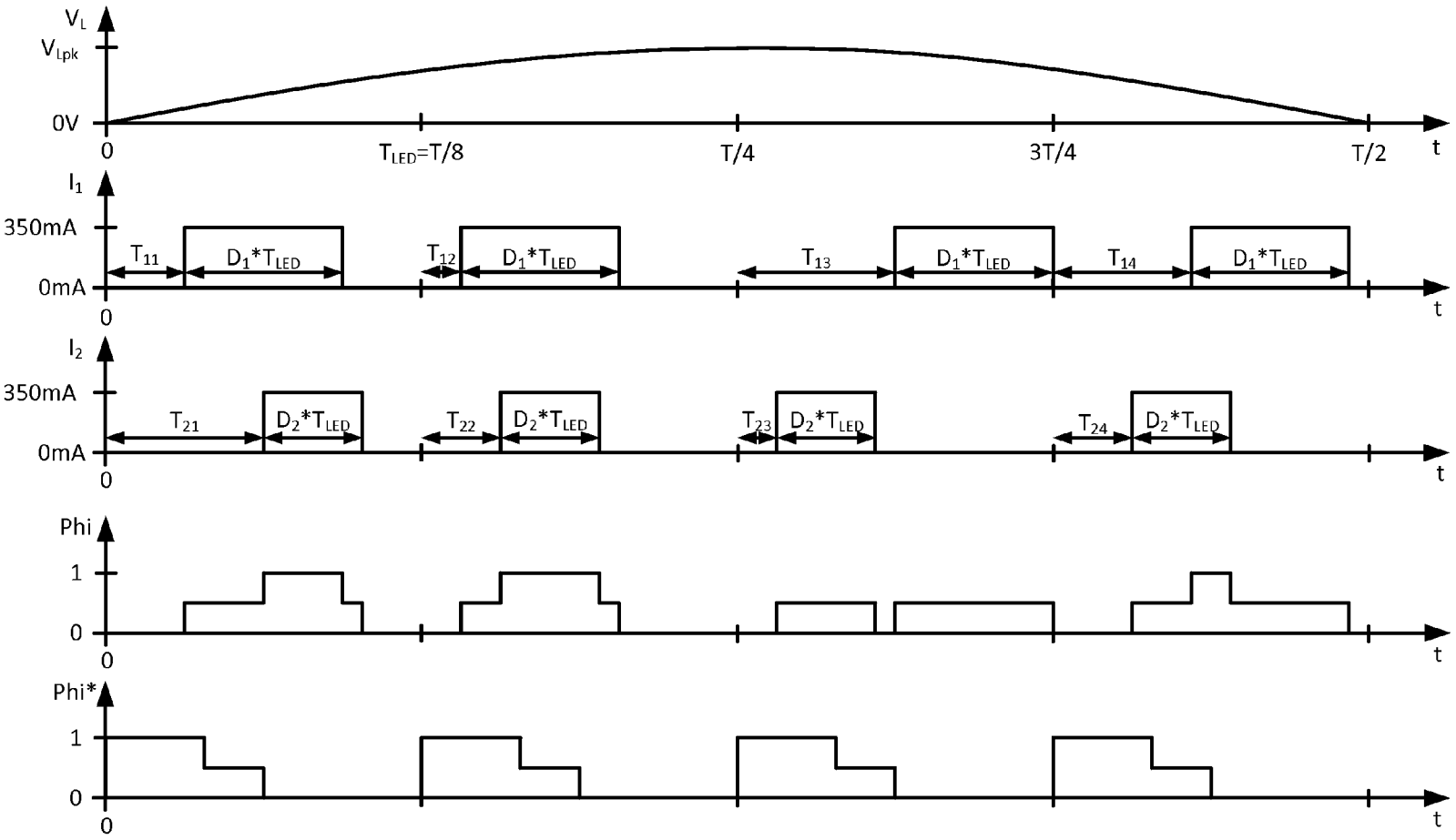
FIG. 3 graphically illustrates the line voltage fed to a 2-channel LED driver, along with the two output currents and relative luminous flux of the driver, in accordance with an embodiment of the present invention.
Figure 4:
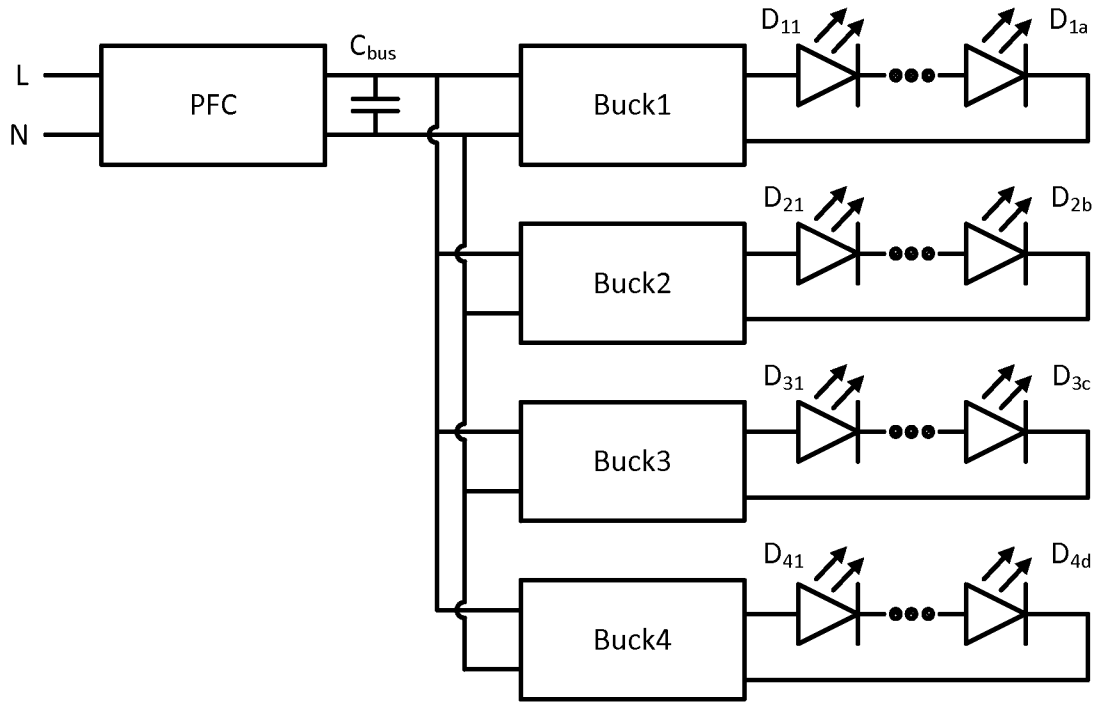
FIG. 4 illustrates a block diagram of a four-channel LED driver configured for synchronized PWM dimming with random phase, in accordance with an embodiment of the present invention.

Another example embodiment that will be apparent in light of the single channel embodiment shown in FIG. 1*a* and the 4-channel embodiment shown in FIG. 4 is a two-channel LED driver based on a boost PFC stage and two buck output stages driving two respective LED strings (basically, like FIG. 4 but with two less buck converter stages). FIG. 3 shows the line voltage $V_L$ fed to the driver and the output currents $I_1$ and $I_2$. The line period T in the upper part of the graph corresponds to a line frequency of $f_L$=50 Hz. In this example case, assume that k was chosen to be 4, and hence the PWM frequency $f_{PWM}$ is eight times the line frequency ($f_{PWM}$=400 Hz), further assuming compliance with $f_{PWM}=k*2*f_L$, in accordance with one example embodiment. For illustration purposes, constant duty cycles $D_1$=50% and $D_2$=25% are shown. The varying delay times of channel 1 ($T_{11}$ through $T_{14}$) and of the channel 2 ($T_{21}$ through $T_{24}$) are clearly visible in FIG. 3. In addition, the relative luminous flux Phi generated by the two LED strings combined is plotted. The two LED strings were chosen to be identical is this example case.

As a point of comparison, note that if standard PWM modulation with a fixed delay time was used for all cycles and all channels, the relative luminous flux Phi* would have been the result. The plot of Phi* in FIG. 3 assumes a delay time of $T_{1x}=T_{2x}=0$ (non-zero delay times $T_{1x}=T_{2x}$ would not alter the result). The relative luminous flux Phi* has a higher degree of symmetry (more frequency components at lower frequencies) and higher averaged modulation depth compared with Phi, hence strobing effects would be more likely with such standard PWM modulation.

Another example embodiment that will be apparent in light of this disclosure includes two single-channel LED drivers. Just as with the previous example embodiment including a two-channel LED driver, assume compliance with $f_{PWM}=k*2*f_L$ and that k was chosen to be 4, the PWM frequency $f_{PWM}$ is eight times the line frequency ($f_{PWM}$=400 Hz, for $f_L$=50 Hz). FIG. 3 would also apply for this two single-channel LED drivers embodiment taking into account that I1 would be the output current of the first driver and the 12 would be the output current of the second driver.

FIG. 4 illustrates a four-channel LED driver configured in accordance with another embodiment of the present invention. As can be seen, this example configuration is based on a PFC stage operatively connected to four converter output stages driving four corresponding LED strings: $D_{11}$ through $D_{1a}$, $D_{21}$ through $D_{2b}$, $D_{31}$ through $D_{3c}$, and $d_{41}$ through $D_{4d}$. As previously explained, any of numerous topologies can be used such as buck, boost, buck-boost, and flyback, but this example embodiment includes a boost PFC stage and buck output stages, which can each be configured as schematically shown in FIG. 1*b*. As will be further appreciated in light of this disclosure, this example architecture generally allows for multiple PWM LED drive circuits all having constant cycle-to-cycle phase angles but different phase angles from drive circuit to drive circuit.

Figure 5:
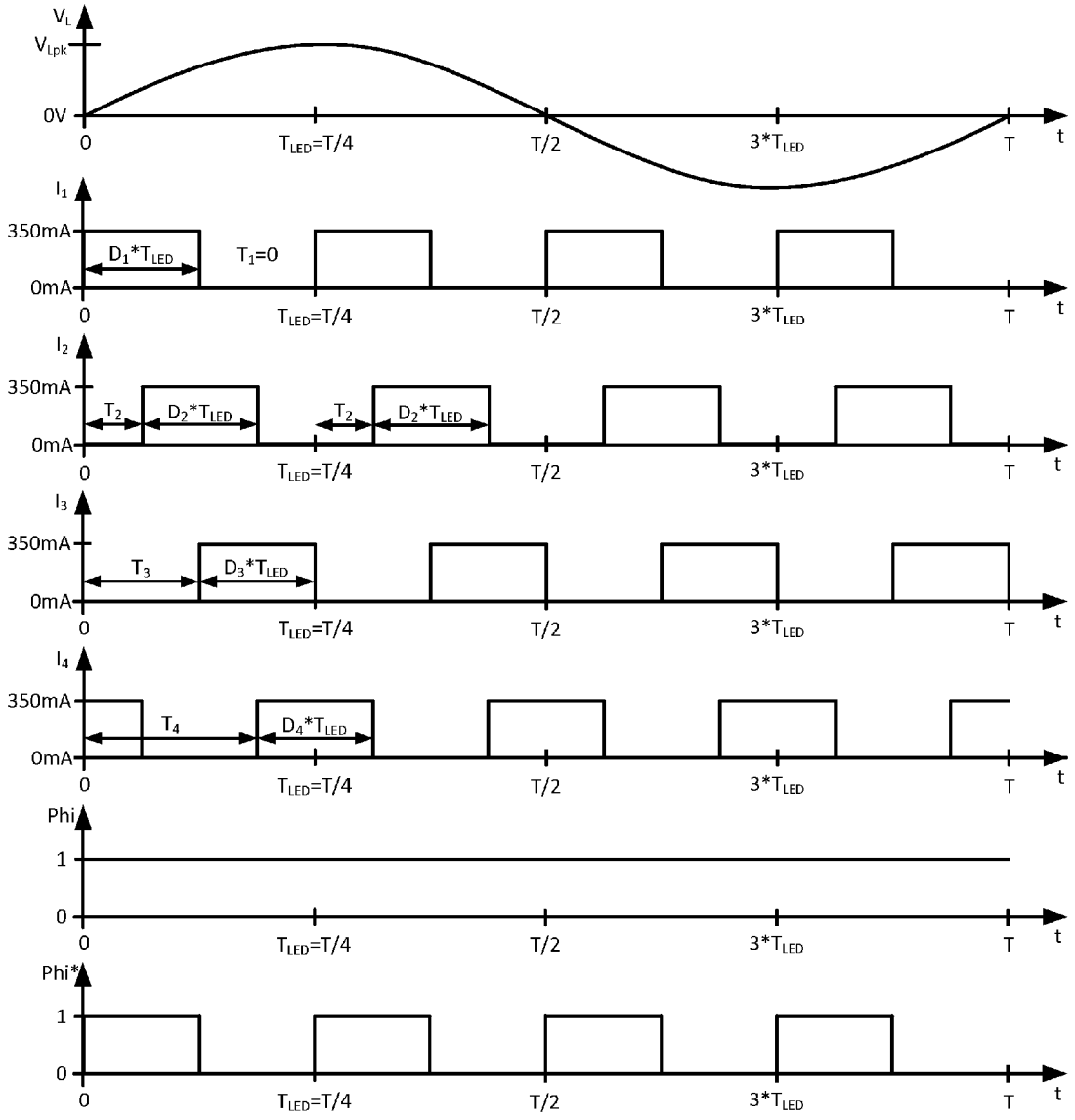
FIGS. 5 and 6 each graphically illustrates the line voltage fed to a four-channel LED driver and the four output currents and relative luminous flux of the driver, with all duty cycles set to 50% and 12.5%, respectively, in accordance with an embodiment of the present invention.
Figure 6:
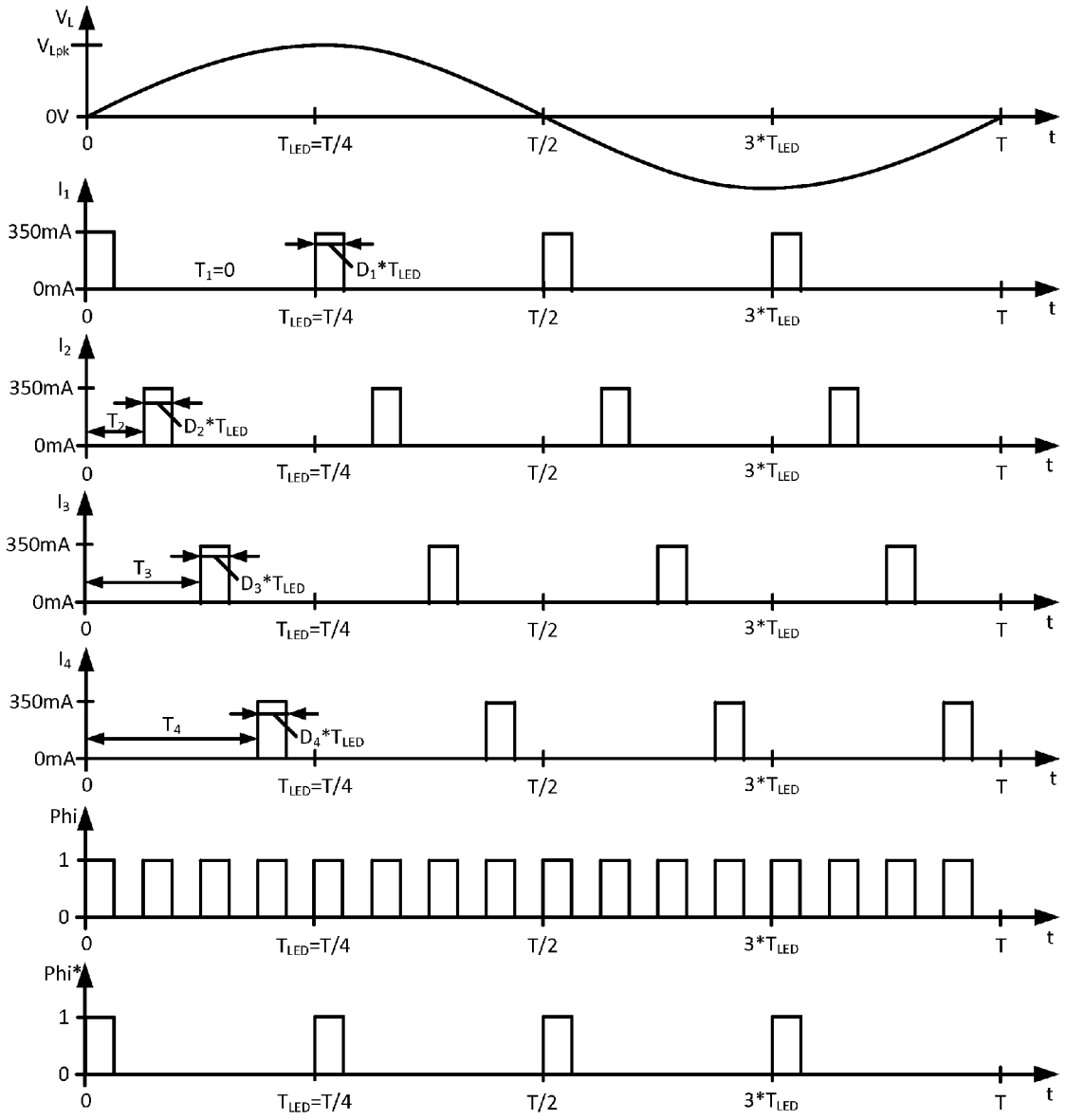

FIGS. 5 and 6 show line voltage $V_L$, output currents $I_1$ through $I_4$, and relative luminous flux Phi corresponding to the example embodiment shown in FIG. 4. The line period T in the upper part of the graph corresponds to a line frequency of $f_L$=60 Hz. Further assume compliance with $f_{PWM}=k*2*f_L$ and that k is 2 and hence the PWM frequency is four times the line frequency ($f_{PWM}$=240 Hz). For illustration purposes, constant duty cycles of $D_1=D_2=D_3=D_4$=50% and $D_1=D_2=D_3=D_4$=12.5% are used in FIGS. 5 and 6, respectively. As can be further seen in both FIGS. 5 and 6, the delay times $T_1$ through $T_4$ of channels 1 through 4 are chosen in such a way so that a phase difference between the channels of 90° is accomplished. As previously explained, the phase angle $\phi_i$ of $i^{th}$ light source can be chosen to be: $\phi_i=(i-1)*\Delta\phi+\phi_0$, where i=1, . . . , f, $\Delta\phi=360°/f$, and $\phi_0$ is an arbitrary and constant phase offset. So, in the example multi-channel LED driver cases shown in FIGS. 4-6, $T_i=T_{LED}*\phi i/360°=T_{LED}*((i-1)*\Delta\phi+\phi 0)/360°$, i=1 . . . n, $\Delta\phi=360°/f$; with number of dominant light sources or so-called channels f=4. The phase offset was arbitrarily set to zero)($\phi 0=0°$. The phase angles so calculated are quantized and equidistant, and thus can be computed easily with a controller such as a microcontroller, digital signal processor, or other suitable processor. As also previously explained, for typical office or home lighting an appropriate value of f may be in the range of 4 to 32.

The plots of FIGS. 5 and 6 also show the relative luminous flux Phi, as previously discussed with reference to FIG. 3. In this example case, Phi is generated by the four LED strings combined. In addition, note that the four LED strings were chosen to be identical, but other embodiments may include diverse LED strings. If standard PWM modulation with fixed and identical delay time was used for all channels the relative luminous flux Phi* would have been the result. The plot of Phi* in FIGS. 5 and 6 assumes a delay time of $T_1=T_2=T_3=T_4=0$ (non-zero delay times $T_1=T_2=T_3=T_4$ would not alter the result). As can be seen, the relative luminous flux Phi* has a higher degree of symmetry (more frequency components at lower frequencies) and higher averaged modulation depth compared with Phi, hence strobing effects would more likely.

Figure 7:
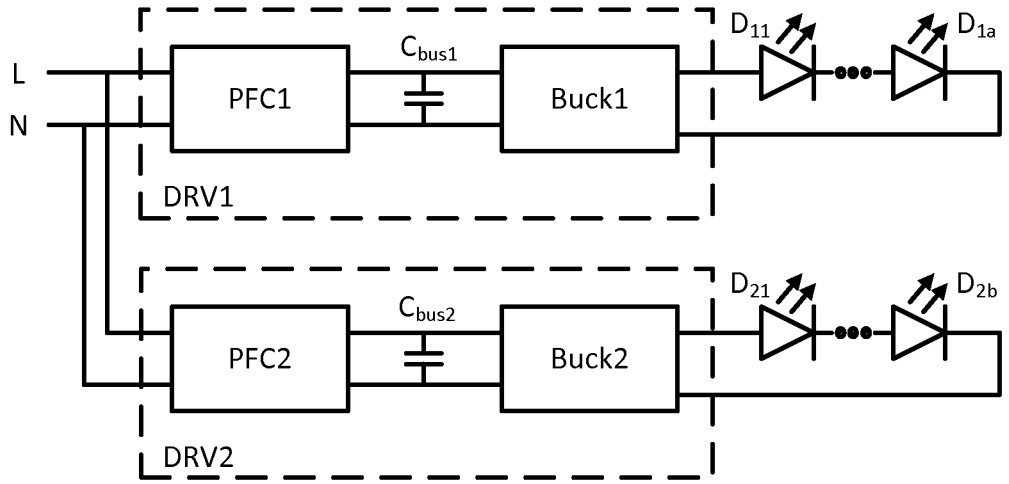
FIG. 7 illustrates a block diagram of two single-channel LED drivers both based on a two stage topology, in accordance with an embodiment of the present invention.

FIG. 7 illustrates a block diagram of two single-channel LED drivers (DRV1 and DRV2) both based on a two stage topology. As can be seen, each of the two single-channel LED drivers is configured with a boost PFC stage and a buck output stage driving a string of LEDs (DRV1 includes PFC1 and Buck1 for driving LEDs $D_{11}$ through $D_{1a}$, and DRV2 includes PFC2 and Buck2 for driving LEDs $D_{21}$ through $D_{2b}$). Other suitable topologies may be used as well, as will be appreciated in light of this disclosure. For purposes of discussion, assume the number of dominant light sources f=4 was chosen, although only two of the four drivers are shown in FIG. 7. In accordance with one such embodiment, further assume that the last two bits of the serial number for each LED driver is used to set the phase angle to either 0°, 90°, 180°, or 270°. This mapping can be done, for example, in firmware or software executable by the microcontroller of the lighting fixture or any other available processor. Table 1 illustrates an example mapping.

TABLE 1

Mapping of serial number to PWM phase angle

| Serial No. | Phase Angle |
|---|---|
| xxx . . . xxx00 | 0° |
| xxx . . . xxx01 | 90° |
| xxx . . . xxx11 | 180° |
| xxx . . . xxx11 | 270° |

Depending on how many drivers are combined in a particular installation Method B will generally be effective, but it will never be worse than the alternative of not taking any measures, which is illustrated by luminous flux Phi*. As previously explained, Method B uses multiple drive circuits with constant cycle-to-cycle phase angle but different phase angles from drive circuit to drive circuit.

Figure 8:
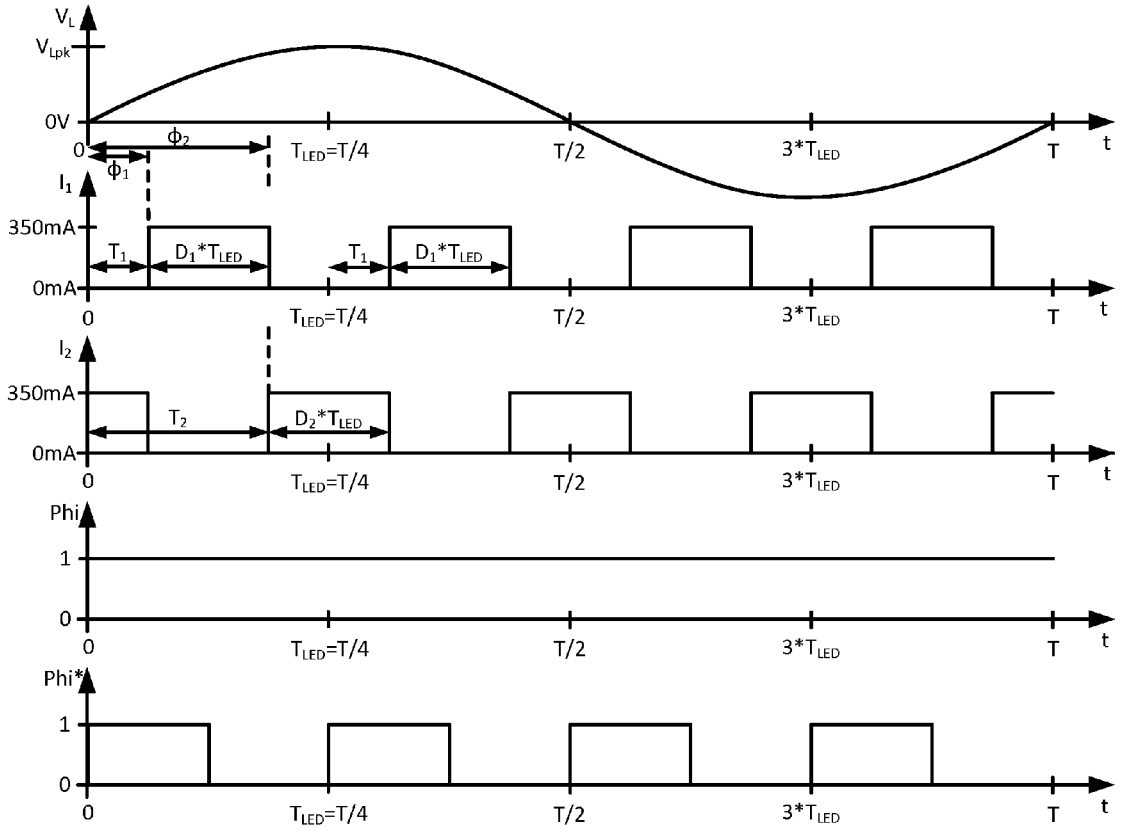
FIG. 8 graphically illustrates a two-channel LED driver (or two single channel drivers, as the case may be) and corresponding signals with phase angles $\phi_1$=90° and $\phi_2$=270°, in accordance with an embodiment of the present invention.
Figure 9:
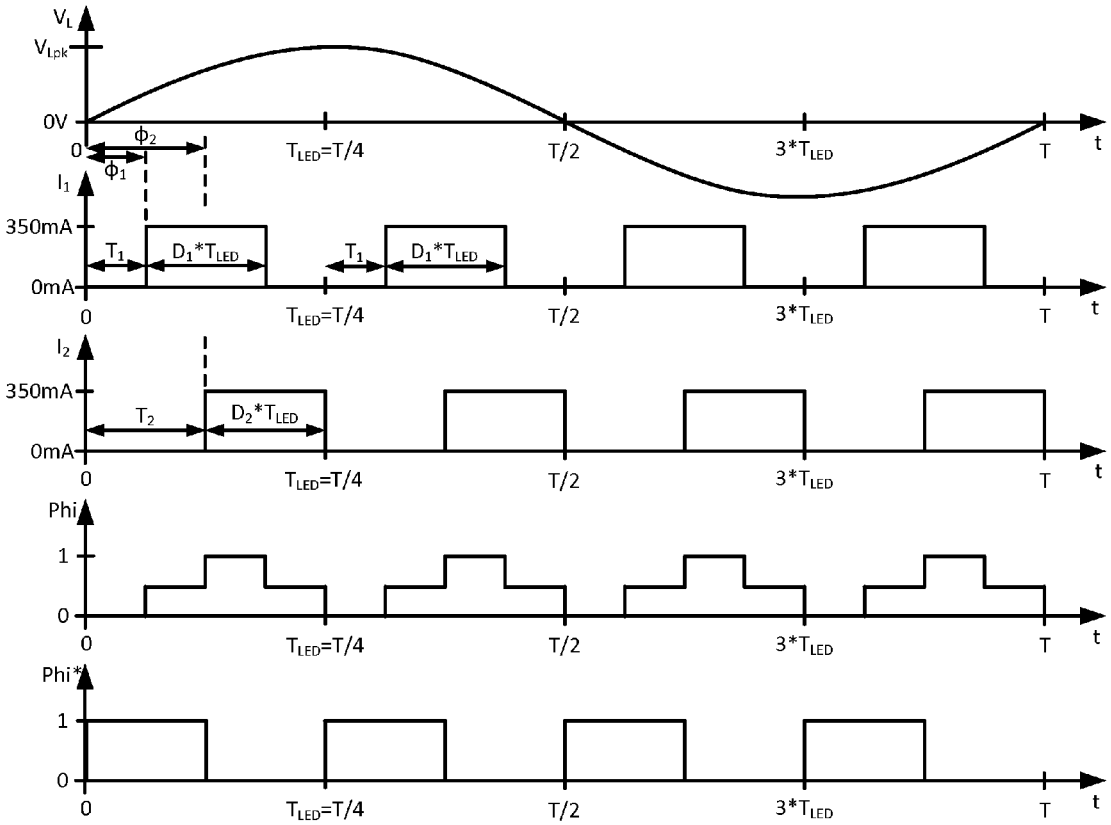
FIG. 9 graphically illustrates a two-channel LED driver (or two single channel drivers, as the case may be) and corresponding signals with phase angles $\phi_1$=90° and $\phi_2$=180°, in accordance with an embodiment of the present invention.

Note that different serial numbers will cause different phase angles to be used. For instance, in one example case (Example 1) two particular driver serial numbers leads to phase angles of $\phi 1=90°$ and $\phi 2=270°$ for those two drivers, whereas in another example case (Example 2) having the same configuration but different drivers and therefore different serial numbers leads to phase angles of $\phi 1=90°$ and $\phi 2=180°$. FIGS. 8 and 9 show line voltage $V_L$, output currents $I_1$ and $I_2$, and relative luminous flux Phi, which might correspond, for instance, to the two single-channel drivers used above in Example 1 and Example 2 respectively. Alternatively, FIGS. 8 and 9 may show line voltage $V_L$, output currents $I_1$ and $I_2$, and relative luminous flux Phi that correspond to a two-channel LED driver. The line period T in the upper part of the graphs corresponds to a line frequency of $f_L=60$ Hz. Further assume compliance with $f_{PWM}=k*2*f_L$ and that k is 2 and hence the PWM frequencies of both drivers DRV1 and DRV2 are four times the line frequency ($f_{PWM}=240$ Hz). For illustration purposes constant duty cycles of $D_1=D_2=50\%$ are used. As can be further seen, FIG. 8 shows the input voltage and output current signals corresponding to a two-channel LED driver (or two single channel drivers) associated with phase angles $\phi_1=90°$ and $\phi_2=270°$ respectively, and FIG. 9 shows those signals corresponding to a two-channel LED driver (or two single channel drivers) associated with phase angles $\phi_1=90°$ and $\phi_2=180°$ respectively. Note that the result depicted in FIG. 8 is preferred over the result depicted in FIG. 9. Thus, for a multi-channel driver, it is desirable for the phase shift between channels to be 360°/N, where N equals the number of channels, in accordance with an embodiment.

With respect to the randomness of driver serial numbers for an embodiment employing multiple drivers, note that the shipping containers for LED drivers can be packed such that drivers are well mixed (with regards to their phase angles) for a given the installation. Moreover, drivers can be installed, for instance, in the same sequence as they are packaged, so as to leverage purposeful packing or otherwise inherent randomness. So, in a given configuration where k equals 4, the drivers may be shipped in cardboard boxes where, for example, there are four drivers in one layer inside the box. The layers of drivers within each box may be separated by a piece of paper or other packing material, which helps minimize the potential for scratches during shipping, but also generally encourages most installers to use up all drivers packaged in one layer of the box before starting with the next layer. In any such cases, using driver serial numbers (or other driver specific data) seems to be a statistically sound randomness generator. Other embodiments may use other random generators, as will be appreciated in light of this disclosure.

In a more general sense, each driver output channel can be associated with a random data point. To this end, reference herein to a "channel" may refer to a channel of a multi-channel driver or to the output of a single channel driver. In this regard, the term channel is not intended to imply one type of configuration such as a multi-channel driver or a single channel driver. Rather, the term "channel" may refer to any such configuration types, as will be appreciated in light of this disclosure.

Figure 10:
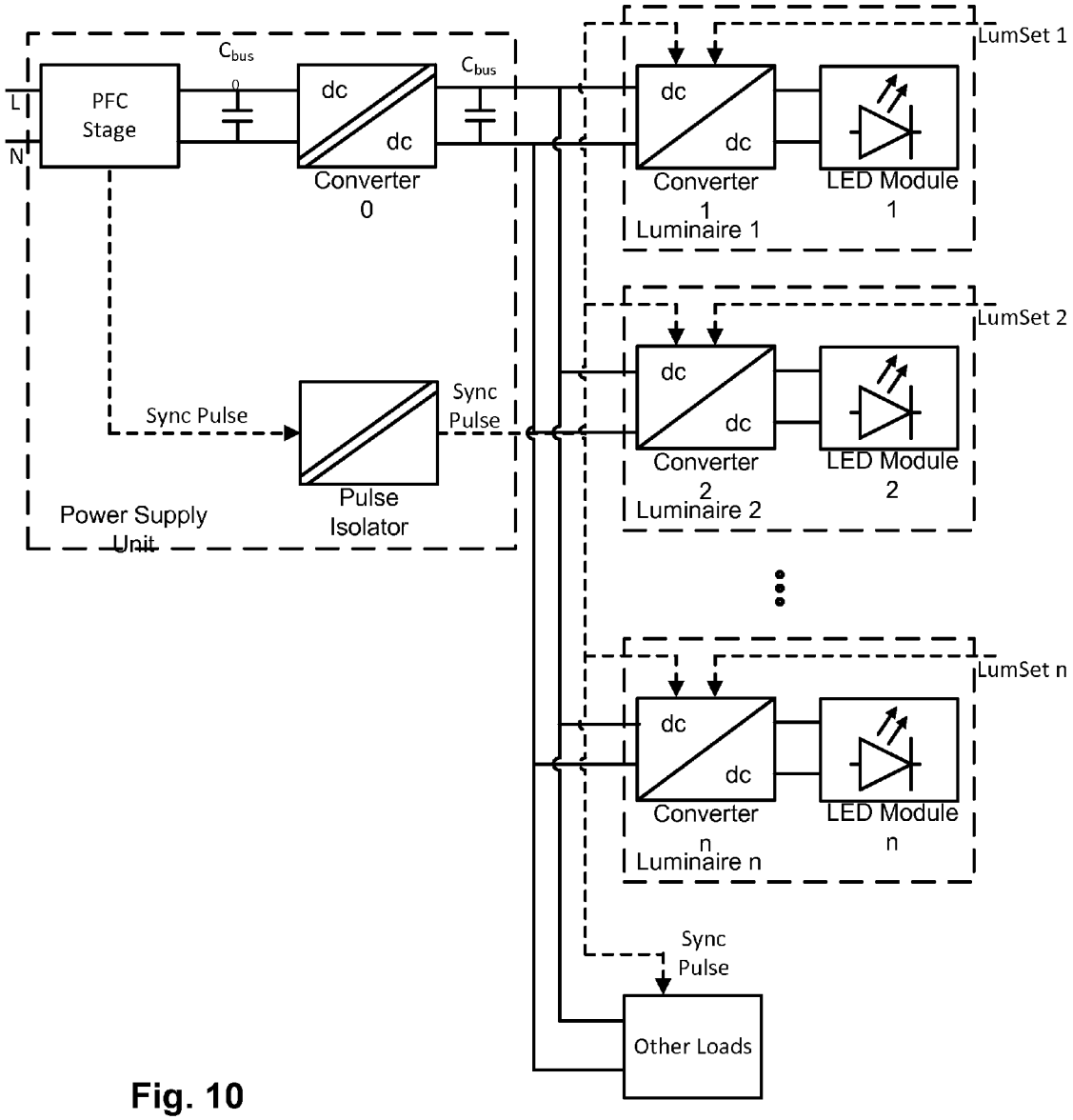
FIG. 10 illustrates a block diagram of a system arrangement with spatially distributed components using LED driver circuitry configured for synchronized PWM dimming with random phase and where the sync pulse is shared among the system components, in accordance with an embodiment of the present invention.

FIG. 10 illustrates a block diagram of a system arrangement with spatially distributed components using LED driver circuitry configured for synchronized PWM dimming with random phase, in accordance with an embodiment of the present invention. As can be seen, the system includes a power supply unit which provides a DC bus (including bus capacitors $C_{bus0}$ and $C_{bus}$). The DC bus powers n luminaires besides other loads. The other loads can be lighting related loads, such as sensors, lighting control systems, and user interfaces and/or non-lighting related loads, such as HVAC system, shading systems, motors, communication devices like TVs and displays, user interfaces, or any other electric load that can be powered by the DC voltage generated by the power supply. The system components may be distributed over a larger area, for example, such as within a room or throughout an entire building, so as to provide any number of lighting arrangements.

As can be further seen, the power supply unit includes two power stages, a PFC stage and Converter 0. Converter 0 is the dc-to-dc converter, which provides galvanic isolation and voltage conversation. In one specific example embodiment, the input voltage to Converter 0 is 450V and the output voltage is 55V. Besides providing power, the power supply unit also provides a central sync pulse which is shared among several other the system components and distributed in the space along with the DC power. The central sync pulse is generated by the PFC and for safety and signal integrity reasons, the sync pulse passes through a pulse isolator which provides galvanic isolation.

The luminaires may contain multiple converters and multiple LED modules, even though only one converter and one LED module per luminaire is shown in this example case. The settings of the luminaire (e.g., intensities and colors) can be manually set at the luminaire or via communication with a light management system. The inputs of those settings are shown schematically by the input lines LumSet 1 through LumSet n of the luminaires 1 through n in FIG. 10. The converters inside the luminaires provide pulse width modulated signals to the LED modules according to either method A or B of this disclosure (as is the case for embodiments shown in FIGS. 11 and 12 as well). The synchronization necessary for either method is provided by the sync pulse over a separate communication line, which also applies to the embodiments shown in FIGS. 11 and 12. The synchronization (e.g., by a sync pulse present the beginning of each line (half) cycle) ensures the same frequency and phase for all converters and loads. The synchronization also prevents other unwanted side-effects that could otherwise result from converters/drivers operating at slightly different frequencies, such as beating effects apparent in low-frequency modulations of the DC bus voltage resulting in light modulation perceivable as flicker.

In another embodiment, the sync pulse is not provided via a separate communication line, but rather is provide over the DC bus by employing DC powerline communication. In some such embodiments, this can be accomplished by modulating the DC powerline with respect to voltage or current output, wherein the modulation of current or voltage values can be done within a given tolerance so as to remain in powerline compliance but still provide a detectable communication signal. Example modulation schemes include the use of a switchable element and/or an adjustable voltage or current source, wherein the switchable element and/or adjustable voltage/current source is responsive to a modulation control signal. Using powerline communication eliminates the need for one or more additional communication wires and at the same time ensures that the sync information is available whenever a system component is connected to power.

Figure 11:
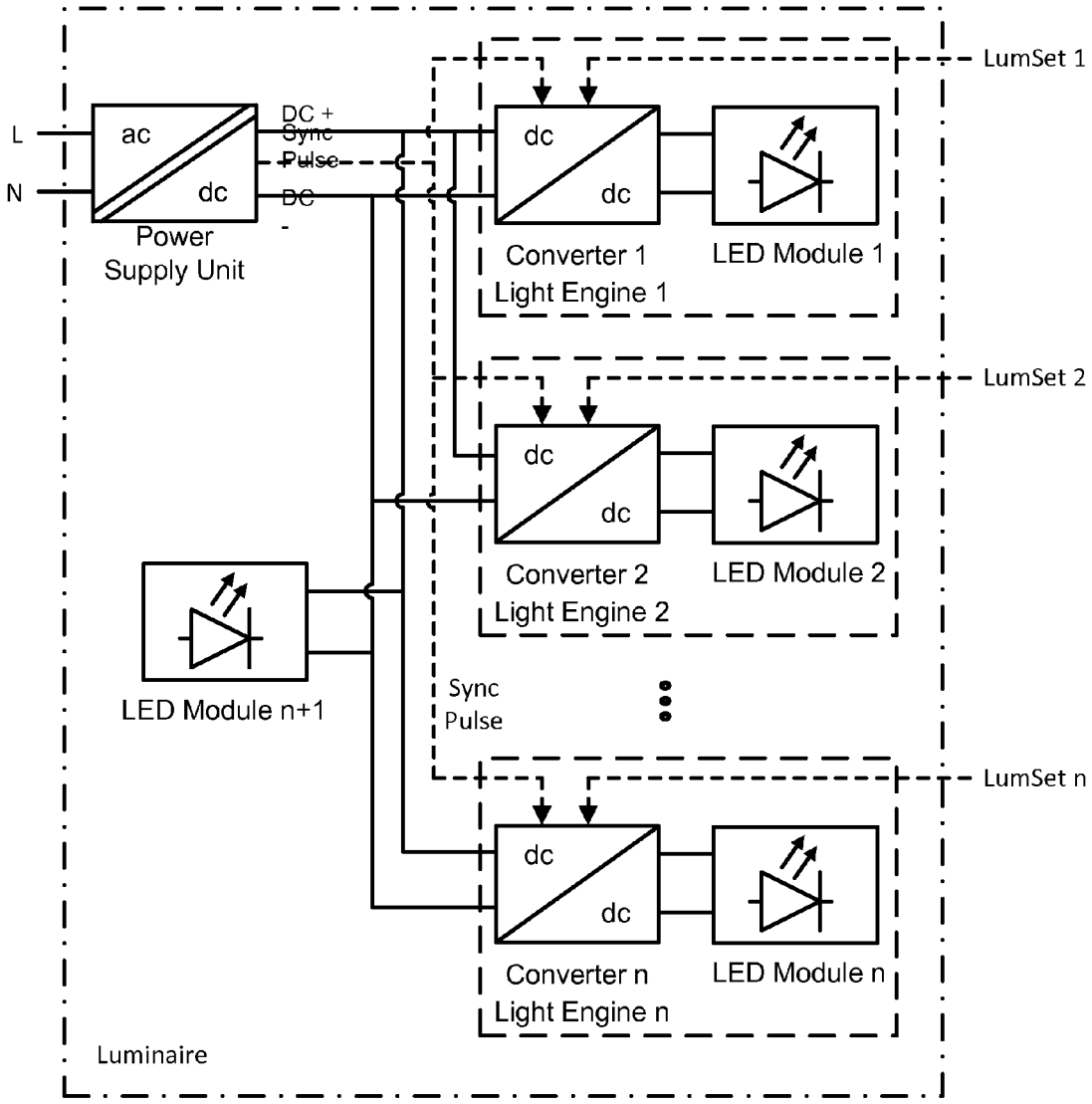
FIG. 11 illustrates a block diagram of a luminaire with spatially distributed components using LED driver circuitry configured for synchronized PWM dimming with random phase and where the sync pulse is shared among the system components, in accordance with an embodiment of the present invention.

FIG. 11 illustrates a block diagram of a luminaire with spatially distributed components using LED driver circuitry configured for synchronized PWM dimming with random phase, in accordance with an embodiment of the present invention. In a similar fashion to the system shown in FIG. 10, the sync pulse is shared among the system components. In contrast to FIG. 10, however, the components in FIG. 11 are part of a single luminaire. The luminaire includes a power supply unit which provides DC power as well as the sync pulse to the n Light Engines. In addition, power is provided to a "dumb" LED Module n+1. LED Module n+1 always runs at full power hence is not PWM dimmed and therefore it need not have sync information to it. The DC power and the sync pulse wire are routed inside the luminaire as a bus using the same wiring and connectors. Besides the Light Engine and the LED Module n+1, the DC power (e.g., 24 VDC) can also be provided, for example, to other lighting system elements, such as an occupancy detector and/or daylight sensor, each of which could also be part of the luminaire.

Figure 12:
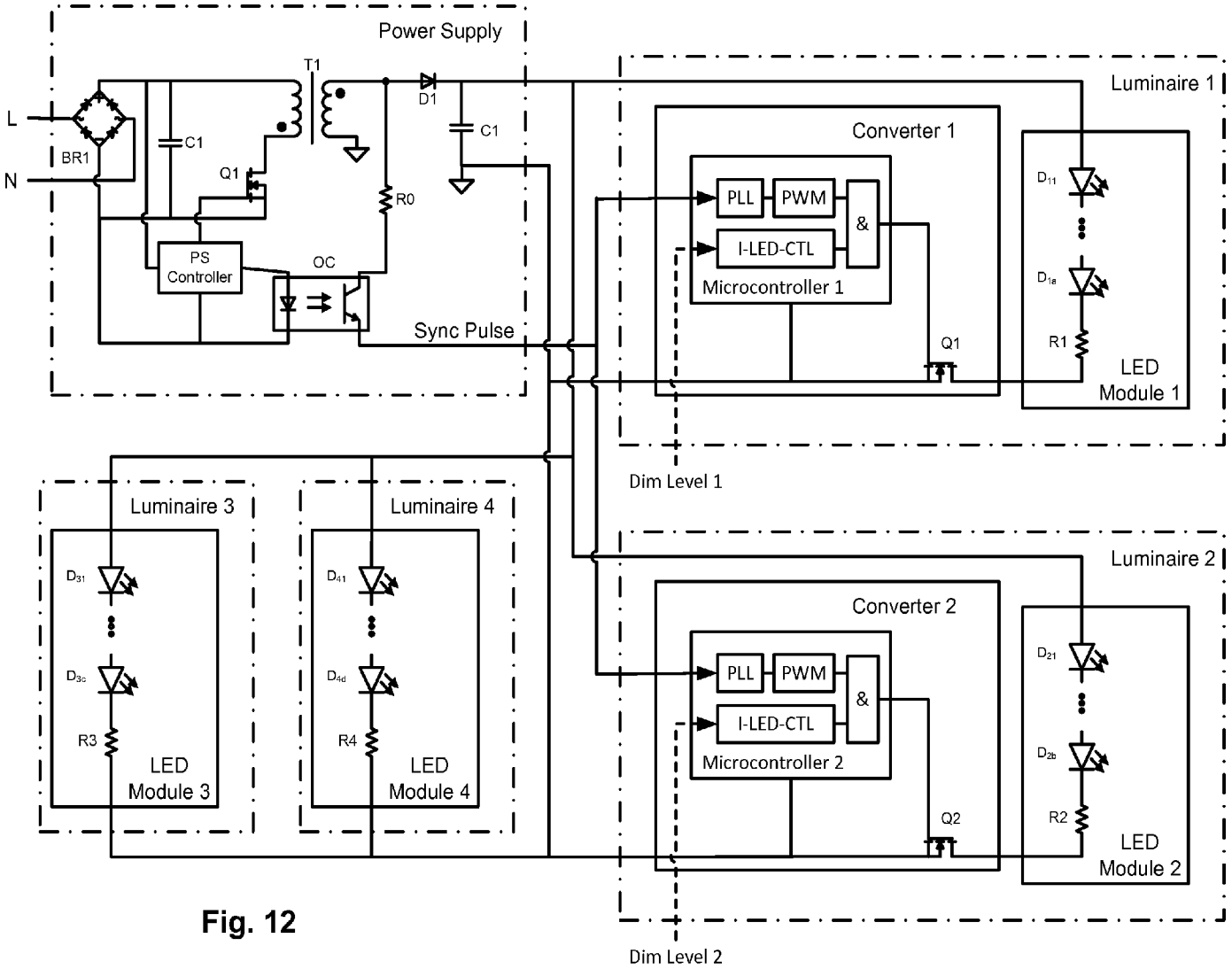
FIG. 12 illustrates an embodiment of a system arrangement with spatially distributed components using LED driver circuitry configured for synchronized PWM dimming with random phase and where the sync pulse is shared among the system components, in accordance with an embodiment of the present invention.

FIG. 12 illustrates an embodiment of a system arrangement with spatially distributed components using LED driver circuitry configured for synchronized PWM dimming with random phase, in accordance with an embodiment of the present invention, where the sync pulse is shared among the system components. As can be seen, the system includes a power supply and four luminaires. The topology of the power supply in this example is a single stage topology. In this particular embodiment, a Flyback converter with respective control circuitry is used to provide power factor correction, voltage conversion, isolation from the mains as well as the sync pulse. An embodiment discussed with respect to FIG. 10 uses a PFC Stage plus the Converter Stage 0 to achieve this functionality. In the embodiment of FIG. 12, both stages can be viewed as merged—at least from the point of mentioned functionalities—into a single stage. The output voltage of the Flyback converter can be, for example, 48 VDC (although other embodiments can use any suitable voltage level). The power supply controller PS Controller is configured to measure the voltage after the bridge rectifier BR1. As will be appreciated in light of this disclosure, this measurement information can in turn be used to create the sync signal (e.g., this signal goes high and low once each cycle of the AC power line to which the converter is connected at its inputs L and N) and besides other information used to control the power transistor Q1 of the Flyback stage. The sync signal generated by the PS Controller drives an optocoupler OC in this example case. On the output of the optocoupler OC, a sync pulse is generated which is shared among the luminaires 1 and 2. In this example embodiment, the LED modules of luminaires 1 and 2 include white LEDs and a current limiting resistor. A user or lighting management system may, if so desired, set the dimming level of the LEDs, indicated by the inputs Dim Level 1 and Dim Level 2. As can be further seen, this information is provided to the microcontroller inside the converter sections of each of the two luminaires 1 and 2. The microcontrollers create a PWM drive signal for the MOSFETs Q1 and Q2, respectively. The MOSFETs Q1 and Q2 are used to chop (turn on and turn off) the input DC voltage (hence, the output of Converters 1 and Converter 2 are pulsating DC), and thereby dim the light generated by the luminaire.

As will be appreciated in light of this disclosure, the techniques provided herein not only help in reducing line frequency induced flicker, but also for line disturbances that are periodic with the line frequency. For instance, assume there is a blip on every other line half-cycle (e.g., every line half-cycle going positive). In case the PWM frequency is synchronized to the line, there will be a 50 Hz modulation in light. This is not desirable, but certainly better than cases of unsynchronized PWM where there are even frequency components in light modulation present that have frequencies below 60 Hz to which the human eye is even more susceptible. In another example case, assume the conditions of the previous case, but assume there is a blip every other line cycle. In this case, with the PWM frequency synchronized to the line, there will be a 30 Hz modulation in light. This is better than cases of unsynchronized PWM where there are even frequency components in light modulation present that have frequencies below 30 Hz (e.g., 15 Hz) to which is even worse as it is close to the max sensitivity of the human eye to flicker (around 8 . . . 10 Hz).

Numerous variations and embodiments will be apparent in light of this disclosure. For instance, one example embodiment provides a lighting driver. The driver include a power factor correction (PFC) stage for receiving a line voltage input having a line frequency and providing a rectified output, and a converter stage for receiving the rectified output from the PFC stage and providing power to a lighting load. The driver further includes a controller configured to provide a pulse width modulated (PWM) dimming control signal to the converter stage, where the PWM dimming control signal has a PWM frequency that is synchronized to the line frequency, and has a randomized phase angle. In some cases, the phase angle of the PWM dimming control signal is randomized on a PWM cycle-to-cycle basis. In some cases, the driver is a multi-channel driver and each channel is configured to provide a corresponding PWM dimming control signal, and the phase angle of the PWM dimming control signal of each channel is randomized on a PWM cycle-to-cycle basis. In some cases, the driver includes multiple single-channel drivers and each single-channel driver is configured to provide a corresponding PWM dimming control signal, and the phase angle of the PWM dimming control signals is randomized from driver-to-driver. In one such case, the phase angle of the PWM dimming control signal of each single-channel driver is constant on a PWM cycle-to-cycle basis for that channel. In some cases, the PWM frequency is k times twice the line frequency, where k can be any positive integer number larger than 0. In some cases, the PFC stage is configured to generate a sync pulse and the controller is configured to receive the sync pulse, thereby allowing the PWM frequency to be synchronized with the line frequency. In some cases, the PFC stage comprises a sync pulse generator configured to generate a sync pulse based on the line voltage input, and the controller comprises a phase-lock-loop (PLL) module and a PWM module, the PWM module configured to generate the PWM dimming control signal, and the PLL module configured to receive the sync pulse and to control the PWM frequency. In some cases, the controller is further configured to generate, at the beginning of each PWM cycle, a quasi-random delay time, so as to provide the randomized phase angle of the PWM dimming control signal. In one such case, the quasi-random delay time generated at the beginning of each PWM cycle is derived from a sequence of quasi-random numbers that are generated by a random number generator. In another such case, the quasi-random delay time generated at the beginning of each PWM cycle is derived from a sequence of quasi-random numbers that are associated with the driver. In some such cases, the sequence of quasi-random numbers associated with the driver comprises at least one of a serial number, an identification number, and/or a logical address of the driver. In some cases, the randomized phase angle can be computed by: $\phi_i=(i-1)*\Delta\phi+\phi_0$, where i=1, . . . , f, $\Delta\phi=360°/f$, f is number of channels or drivers, and $\phi_0$ is an arbitrary and constant phase offset. In some cases, the randomized phase angle is one of programmed into a memory accessible by the controller or generated by the controller at power-up.

Another embodiment of the present invention provides a driver for LED-based lighting systems. The driver includes a power factor correction (PFC) stage for receiving a line voltage input having a line frequency and providing a rectified output, the PFC stage being further configured to generate a sync pulse. The driver further includes a buck converter stage for receiving the rectified output from the PFC stage and providing power to a lighting load, and a controller configured to receive the sync pulse and provide a pulse width modulated (PWM) dimming control signal to the converter stage. The PWM dimming control signal has a PWM frequency that is synchronized to the line frequency, and has a randomized phase angle, wherein the PWM frequency is k times twice the line frequency, where k can be any positive integer number larger than 0. In some cases, the phase angle of the PWM dimming control signal is randomized on a PWM cycle-to-cycle basis. In some cases, the driver is a multi-channel driver and each channel is configured to provide a corresponding PWM dimming control signal, and the phase angle of the PWM dimming control signal of each channel is randomized on a PWM cycle-to-cycle basis. In some cases, the driver includes multiple single-channel drivers and each single-channel driver is configured to provide a corresponding PWM dimming control signal, and the phase angle of the PWM dimming control signals is randomized from driver-to-driver. In one such case, the phase angle of the PWM dimming control signal of each single-channel driver is constant on a PWM cycle-to-cycle basis for that channel. In some cases, the controller is further configured to generate, at the beginning of each PWM cycle, a quasi-random delay time, so as to provide the randomized phase angle of the PWM dimming control signal, wherein the quasi-random delay time generated at the beginning of each PWM cycle is one of: programmed into a memory accessible by the controller; derived from a sequence of quasi-random numbers that are generated by a random number generator; or derived from a sequence of quasi-random numbers that are associated with the driver. In some cases, the randomized phase angle can be computed by: $\phi_i=(i-1)*\Delta\phi+\phi_0$, where i=1, . . . , f, $\Delta\phi=360°/f$, f is number of channels or drivers, and coo is an arbitrary and constant phase offset.

Another embodiment of the present invention provides a pulse width modulated (PWM) dimming methodology for lighting systems. The method includes receiving, at a power factor correction (PFC) stage, a line voltage input having a line frequency and providing a rectified output. The method further includes receiving, at a converter stage, the rectified output from the PFC stage and providing power to a lighting load. The method further includes providing, via a controller, a pulse width modulated (PWM) dimming control signal to the converter stage, where the PWM dimming control signal has a PWM frequency that is synchronized to the line frequency, and has a randomized phase angle. In some cases, the phase angle of the PWM dimming control signal is randomized on a PWM cycle-to-cycle basis. In some cases, the method uses multiple single-channel drivers and each single-channel driver is configured to provide a corresponding PWM dimming control signal, and the phase angle of the PWM dimming control signals is randomized from driver-to-driver, and wherein the phase angle of the PWM dimming control signal of each single-channel driver is constant on a PWM cycle-to-cycle basis for that channel. In some cases, the PWM frequency is k times twice the line frequency, where k can be any positive integer number larger than 0.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A lighting driver, comprising:

a power factor correction (PFC) stage for receiving a line voltage input having a line frequency and providing a rectified output;

a converter stage for receiving the rectified output from the PFC stage and providing power to a lighting load; and a controller configured to provide a pulse width modulated (PWM) dimming control signal to the converter stage, where the PWM dimming control signal has a PWM frequency that is synchronized to the line frequency, and has a randomized phase angle.

2. The driver of claim 1, wherein the phase angle of the PWM dimming control signal is randomized on a PWM cycle-to-cycle basis.

3. The driver of claim 1, wherein the driver is a multi-channel driver and each channel is configured to provide a corresponding PWM dimming control signal, and the phase angle of the PWM dimming control signal of each channel is randomized on a PWM cycle-to-cycle basis.

4. The driver of claim 1, wherein the driver includes multiple single-channel drivers and each single-channel driver is configured to provide a corresponding PWM dimming control signal, and the phase angle of the PWM dimming control signals is randomized from driver-to-driver.

5. The driver of claim 4, wherein the phase angle of the PWM dimming control signal of each single-channel driver is constant on a PWM cycle-to-cycle basis for that channel.

6. The driver of claim 1, wherein the PWM frequency is k times twice the line frequency, where k can be any positive integer number larger than 0.

7. The driver of claim 1, wherein the PFC stage is configured to generate a sync pulse and the controller is configured to receive the sync pulse, thereby allowing the PWM frequency to be synchronized with the line frequency.

8. The driver of claim 1, wherein:

the PFC stage comprises a sync pulse generator configured to generate a sync pulse based on the line voltage input; and the controller comprises a phase-lock-loop (PLL) module and a PWM module, the PWM module configured to generate the PWM dimming control signal, and the PLL module configured to receive the sync pulse and to control the PWM frequency.

9. The driver of claim 1, wherein the controller is further configured to generate, at the beginning of each PWM cycle, a quasi-random delay time, so as to provide the randomized phase angle of the PWM dimming control signal.

10. The driver of claim 9, wherein the quasi-random delay time generated at the beginning of each PWM cycle is derived from a sequence of quasi-random numbers that are generated by a random number generator.

11. The driver of claim 9, wherein the quasi-random delay time generated at the beginning of each PWM cycle is derived from a sequence of quasi-random numbers that are associated with the driver.

12. The driver of claim 11, wherein the sequence of quasi-random numbers associated with the driver comprises at least one of a serial number, an identification number, and/or a logical address of the driver.

13. The driver of claim 1, wherein the randomized phase angle can be computed by: $\phi i=(i-1)*\Delta\phi+\phi 0$, where $i=1, \ldots, f$, $\Delta\phi=360°/f$, f is number of channels or drivers, and $\phi 0$ is an arbitrary and constant phase offset.

14. The driver of claim 1, wherein the randomized phase angle is one of programmed into a memory accessible by the controller or generated by the controller at power-up.

15. A driver for LED-based lighting systems, comprising:

a power factor correction (PFC) stage for receiving a line voltage input having a line frequency and providing a rectified output, the PFC stage being further configured to generate a sync pulse;

a buck converter stage for receiving the rectified output from the PFC stage and providing power to a lighting load; and a controller configured to receive the sync pulse and provide a pulse width modulated (PWM) dimming control signal to the converter stage, where the PWM dimming control signal has a PWM frequency that is synchronized to the line frequency, and has a randomized phase angle, wherein the PWM frequency is k times twice the line frequency, where k can be any positive integer number larger than 0.

16. The driver of claim 15, wherein the phase angle of the PWM dimming control signal is randomized on a PWM cycle-to-cycle basis.

17. The driver of claim 15, wherein the driver is a multi-channel driver and each channel is configured to provide a corresponding PWM dimming control signal, and the phase angle of the PWM dimming control signal of each channel is randomized on a PWM cycle-to-cycle basis.

18. The driver of claim 15, wherein the driver includes multiple single-channel drivers and each single-channel driver is configured to provide a corresponding PWM dimming control signal, and the phase angle of the PWM dimming control signals is randomized from driver-to-driver.

19. The driver of claim 18, wherein the phase angle of the PWM dimming control signal of each single-channel driver is constant on a PWM cycle-to-cycle basis for that channel.

20. The driver of claim 15, wherein the controller is further configured to generate, at the beginning of each PWM cycle, a quasi-random delay time, so as to provide the randomized phase angle of the PWM dimming control signal, wherein the quasi-random delay time generated at the beginning of each PWM cycle is one of:

programmed into a memory accessible by the controller;

derived from a sequence of quasi-random numbers that are generated by a random number generator; or derived from a sequence of quasi-random numbers that are associated with the driver.

21. The driver of claim 15, wherein the randomized phase angle can be computed by: $\phi i=(i-1)*\Delta\phi+\phi 0$, where $i=1, \ldots, f$, $\Delta\phi=360°/f$, f is number of channels or drivers, and $\phi 0$ is an arbitrary and constant phase offset.

22. A pulse width modulated (PWM) dimming methodology for lighting systems, the method comprising:

receiving, at a power factor correction (PFC) stage, a line voltage input having a line frequency and providing a rectified output;

receiving, at a converter stage, the rectified output from the PFC stage and providing power to a lighting load; and providing, via a controller, a pulse width modulated (PWM) dimming control signal to the converter stage, where the PWM dimming control signal has a PWM frequency that is synchronized to the line frequency, and has a randomized phase angle.

23. The method of claim 22, wherein the phase angle of the PWM dimming control signal is randomized on a PWM cycle-to-cycle basis.

24. The method of claim 22, wherein the method uses multiple single-channel drivers and each single-channel driver is configured to provide a corresponding PWM dimming control signal, and the phase angle of the PWM dimming control signals is randomized from driver-to-driver, and wherein the phase angle of the PWM dimming control signal of each single-channel driver is constant on a PWM cycle-to-cycle basis for that channel.

25. The method of claim 22, wherein the PWM frequency is k times twice the line frequency, where k can be any positive integer number larger than 0.

* * * * *